US011459802B2

(12) United States Patent
Estrada Lazcano et al.

(10) Patent No.: US 11,459,802 B2
(45) Date of Patent: Oct. 4, 2022

(54) BUMPER COMPONENT FOR VEHICLE LATCH ASSEMBLY

(71) Applicant: Inteva Products, LLC, Troy, MI (US)

(72) Inventors: Oscar Omar Estrada Lazcano, Chih (MX); Hector Sanchez, Chih (MX); Fernando Chacon, Chih (MX); Carlos I. Tostado Bocanegra, Chih (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 627 days.

(21) Appl. No.: 16/005,120

(22) Filed: Jun. 11, 2018

(65) Prior Publication Data

US 2019/0376321 A1 Dec. 12, 2019

(51) Int. Cl.
*E05B 77/38* (2014.01)
*E05B 79/04* (2014.01)

(52) U.S. Cl.
CPC ..... *E05B 77/38* (2013.01); *E05B 79/04* (2013.01)

(58) Field of Classification Search
CPC ..... E05B 77/38; E05B 79/04; E05B 77/42; E05B 77/36
USPC ..... 292/337
See application file for complete search history.

(56) References Cited

U.S. PATENT DOCUMENTS

2011/0133493 A1* 6/2011 Perkins ..... E05B 85/26 292/216
2012/0281394 A1* 11/2012 Weber ..... F21L 4/005 362/186
2016/0290016 A1 10/2016 Enomoto et al.
2016/0290020 A1 10/2016 Nozawa et al.

FOREIGN PATENT DOCUMENTS

CN 102059990 A 5/2011
CN 202544562 U * 11/2012
CN 202544562 U 11/2012
CN 203925042 U 11/2014
CN 105658891 A 6/2016
CN 107075883 A 8/2017
CN 110485835 A * 11/2019
JP S60191655 U 12/1985
WO WO-2019141307 A1 * 7/2019 ..... E05B 81/62

OTHER PUBLICATIONS

Second Chinese Office Action for Application No. 2018110840884; dated Feb. 2, 2021.
Chinese Search Report for Application No. 2018110840884; dated Jul. 16, 2020.
First Office Action for Application No. 2018110840884; dated Jul. 22, 2020.

(Continued)

*Primary Examiner* — Kristina R Fulton
*Assistant Examiner* — James E Ignaczewski
(74) *Attorney, Agent, or Firm* — Cantor Colburn LLP

(57) ABSTRACT

A vehicle latch assembly includes a housing. Also included is a pawl disposed within the housing, the pawl rotatable between a first angular position and a second angular position. Further included is a bumper operatively coupled to the housing, the bumper having a conical head portion positioned for engagement with the pawl in the second angular position of the pawl.

10 Claims, 4 Drawing Sheets

(56) References Cited

OTHER PUBLICATIONS

Second Chinese Search Report for Application No. 2018110840884; dated Jan. 22, 2021.
English Translation to Second Chinese Office Action for Application No. 2018110840884; dated Feb. 2, 2021.
Chinese Office Action for Application No. 2018110840884; dated Jun. 8, 2021.
English Translation to Chinese Office Action for Application No. 2018110840884; dated Jun. 8, 2021.
Decision on Rejection for Chinese Application No. 201811084088.4 dated Dec. 20, 2021.
Translation of Decision on Rejection for Chinese Application No. 201811084088.4 dated Dec. 20, 2021.

* cited by examiner

BUMPER COMPONENT FOR VEHICLE LATCH ASSEMBLY

BACKGROUND

The subject matter disclosed herein relates to vehicle door latches.

Vehicle door latches must meet strength and sound requirements for various markets. Rubber or bumper components are highly sensitive to the ambient temperature and humidity. The sensitivity to temperature and humidity generates dimensional variations directly proportional to the volume used in the component. The components must maintain operating requirements over a wide range of temperatures to meet customer and/or regulatory standards. For example, the components must operate between −40 degrees Celsius and 80 degrees Celsius. At the low temperatures, the rubber components are too hard for desired operation. Conversely, the rubber components are too soft at high temperatures for desired operation. Either extreme adversely may affect the sound performance considerably and directly affect latch bite control as well.

SUMMARY

Disclosed is a vehicle latch assembly including a housing. Also included is a pawl disposed within the housing, the pawl rotatable between a first angular position and a second angular position. Further included is a bumper operatively coupled to the housing, the bumper having a conical head portion positioned for engagement with the pawl in the second angular position of the pawl.

Also disclosed is a vehicle latch assembly including a housing. Also included is a bumper operatively coupled to the housing, the bumper having a conical head portion positioned for engagement with a latch component. Further included is a plurality of heat stake posts formed on the housing to operatively couple components of the vehicle latch assembly.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawing in which:

Figure 1:
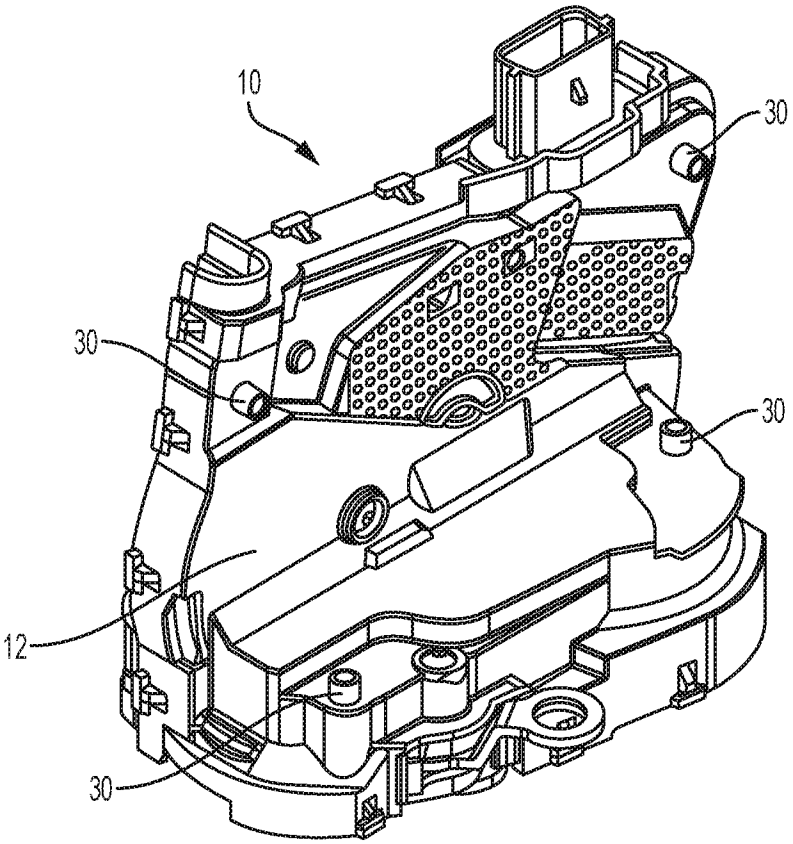
FIG. 1 is a perspective view of a vehicle latch assembly.

The detailed description explains embodiments of the invention, together with advantages and features, by way of example with reference to the drawing.

DETAILED DESCRIPTION OF THE INVENTION

Referring to FIG. 1, reference numeral 10 generally designates a vehicle latch assembly according to a first embodiment. The vehicle latch assembly 10 is generally designed for use on a vehicle (not illustrated) having a vehicle door with a door handle. The vehicle latch assembly 10 may be installed on the driver side door or a passenger side door in some embodiments. Additionally, it is contemplated that the vehicle latch assembly 10 may be installed in alternative locations of the vehicle, such as a vehicle door opening on the B-pillar or may be used in conjunction with a rear door of the vehicle, such as a liftgate, trunk or tailgate, for example.

The vehicle latch assembly 10 includes a housing 12 that helps protect the vehicle latch assembly 10 from damage, as well as dirt and debris. The housing 12 is mounted to the vehicle door, such as with a plurality of mechanical fasteners or welding, for example.

Figure 2:
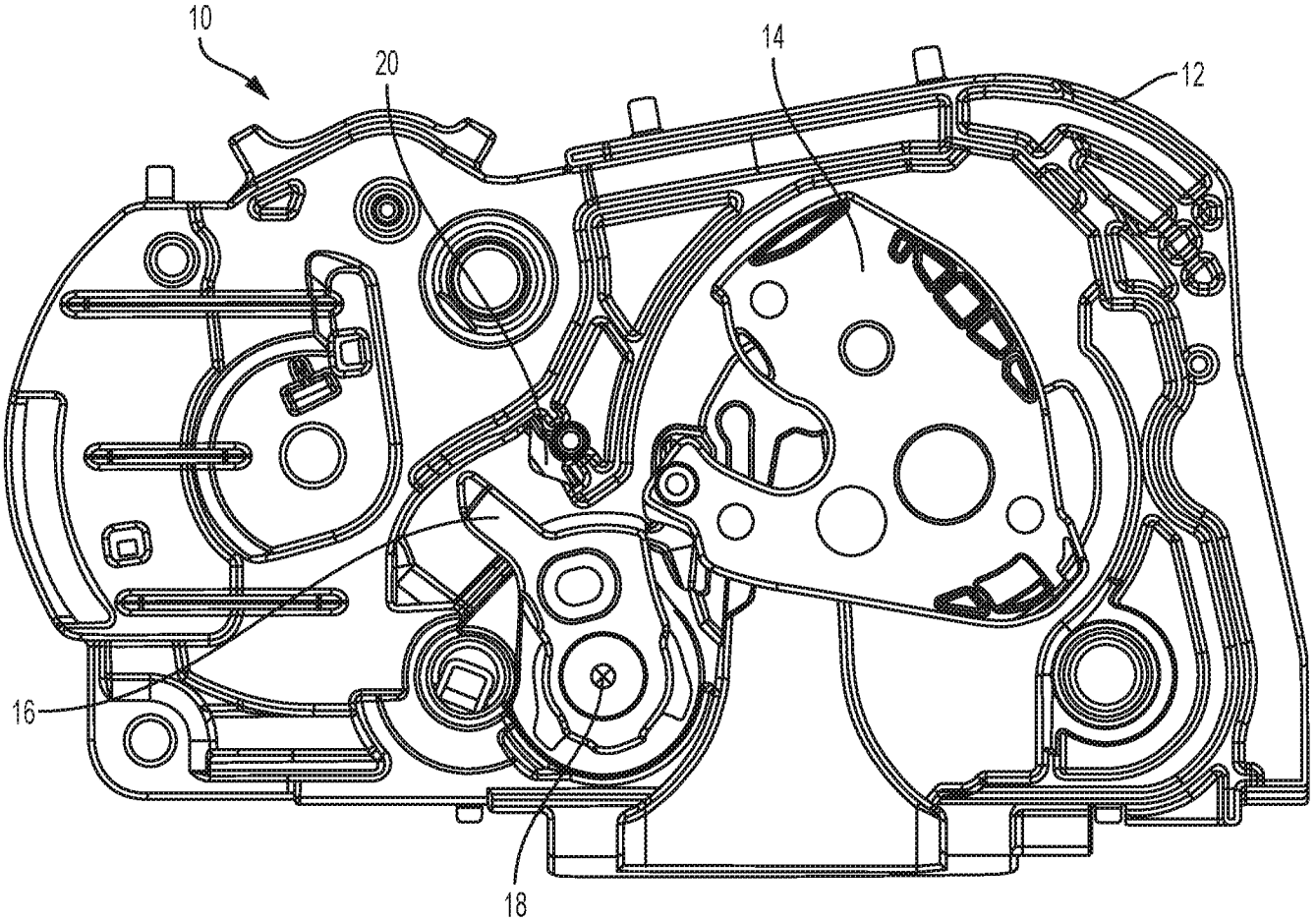
FIG. 2 is an elevational, partial sectional view of the vehicle latch assembly with a pawl in a first position.
Figure 3:
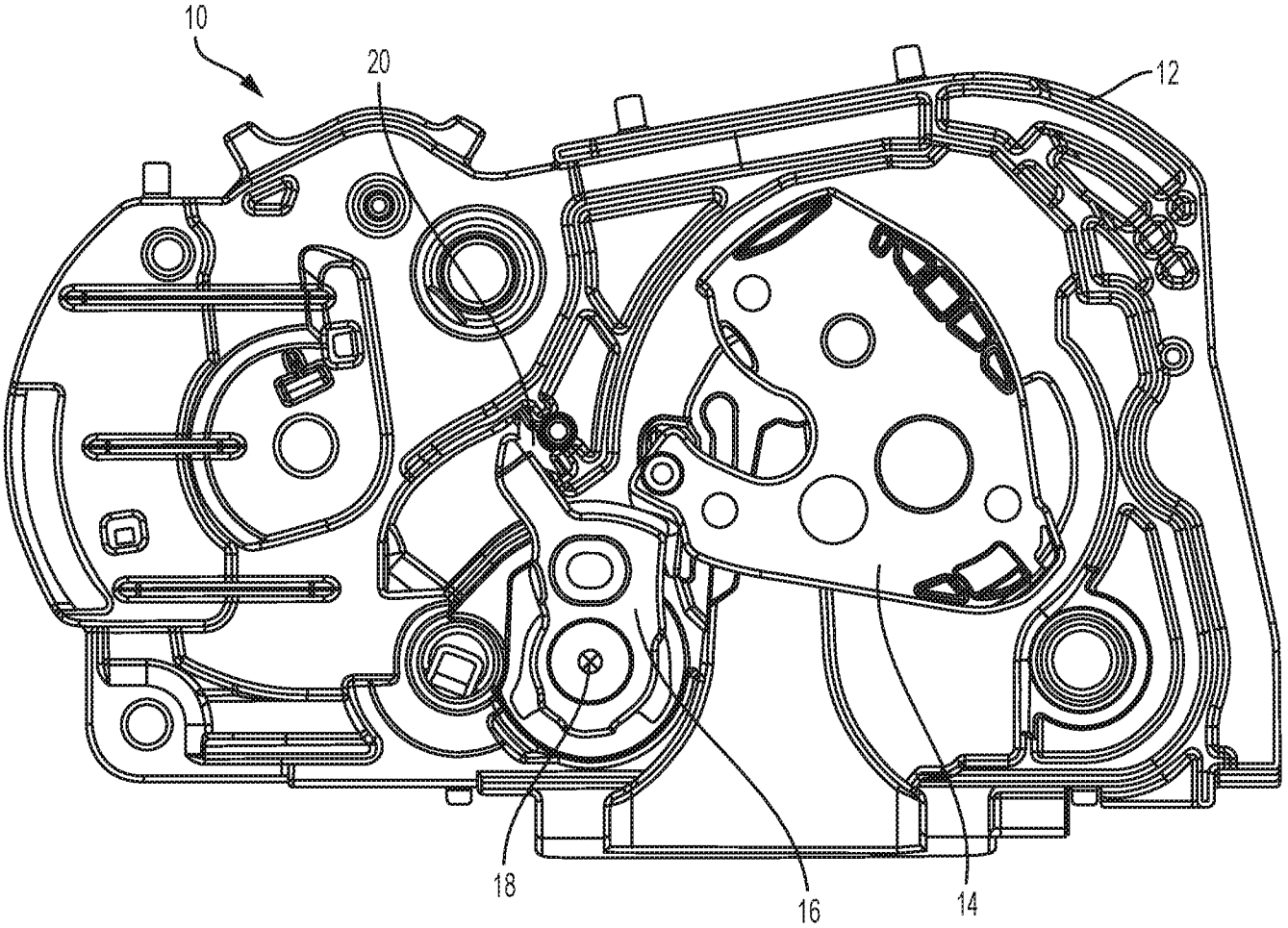
FIG. 3 is an elevational, partial sectional view of the vehicle latch assembly with the pawl in a second position.

FIGS. 2 and 3 show the vehicle latch assembly 10 with the housing partially removed in a cross-sectional manner to illustrate various interior components of the vehicle latch assembly 10. A rotatable claw 14 releasably retains a striker (not shown) to hold the door (or liftgate, trunk, tailgate, etc.) in a closed position. The claw 14 is held in the closed position by a pawl 16. The pawl 16 is actuated to disengage from the claw 14, thereby allowing the claw 14 to be released and biased toward an open position. This operation releases the striker from the claw 14 and facilitates an opening of the vehicle door. The pawl 16 is shown in a first position in FIG. 2 and a second position in FIG. 3.

The pawl 16 is at least partially disposed within the housing. The pawl 16 is pivotable about an axis 18 and rotatable between different operating positions. As the pawl 16 is rotated toward the second position, the pawl 16 comes into close proximity with one or more components and contact may occur. If the pawl 16 contacts the component, an audible sound may be generated which is likely to be unpleasant to a user.

Figure 6:
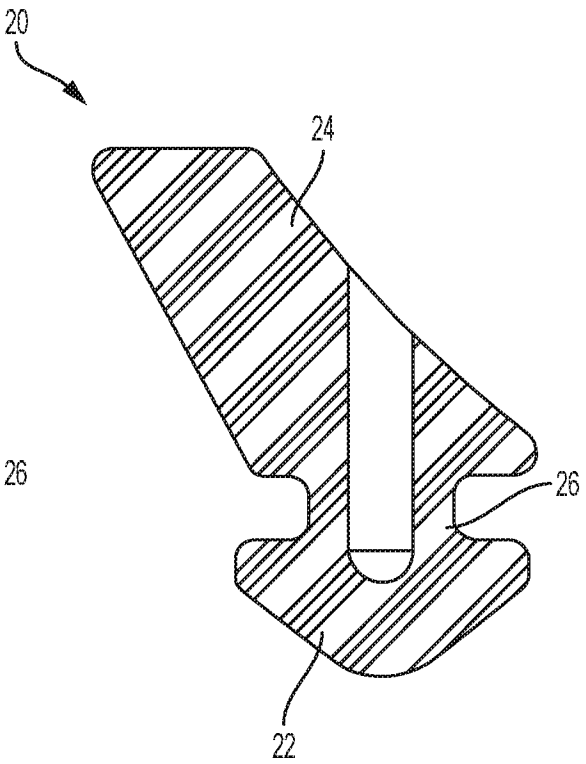
FIG. 6 is a cross-sectional view of the bumper component.
Figure 5:
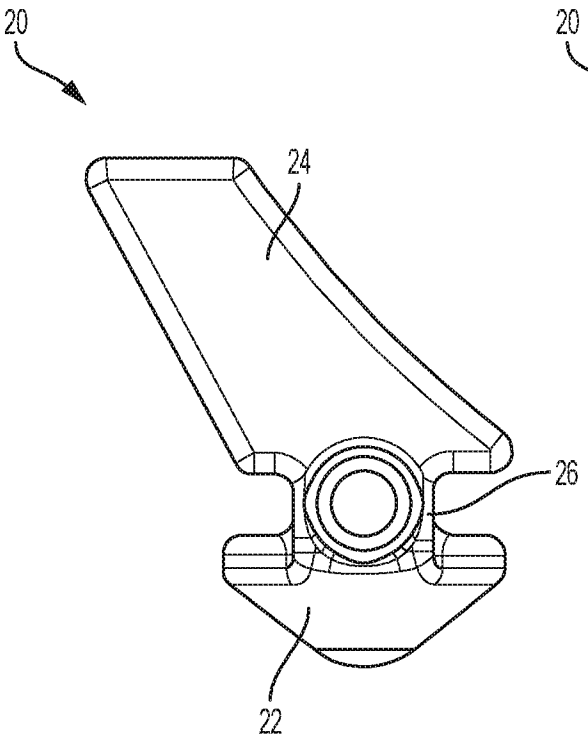
FIG. 5 is an elevational view of the bumper component.
Figure 4:
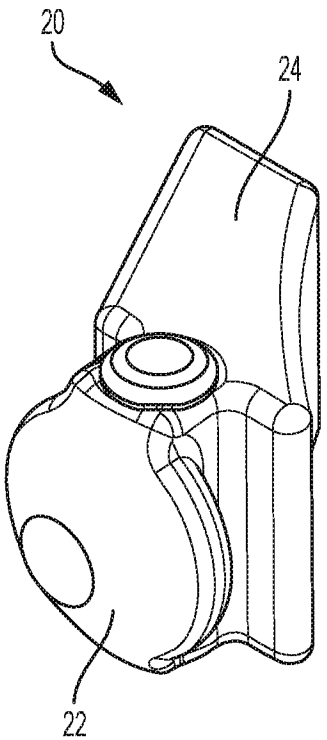
FIG. 4 is a perspective view of a bumper component of the vehicle latch assembly.

Referring now to FIGS. 4-6, a bumper component 20 is illustrated. The bumper component 20 is operatively coupled to the housing 12 and/or a latch component housed within the housing 12. The bumper component 20 is positioned to be in contact with the pawl 16 when the pawl is rotated to the second position of FIG. 3. The bumper component 20 may be formed of rubber, a polymer, or any other suitable material. The bumper component 20 has a head portion 22 that is substantially conical in shape. The conical shape of the head portion 22 provides less resistance to deformation during environmental condition changes, such as temperature and humidity, for example. The lower deformation resistance of the head portion 22 is attributed to the fact that it is easier to deform a shape that changes progressively into a larger form —such as a conical shape— when compared to a shape that has a constant cross-sectional area, where the distribution of energy would be constant across the geometry. The variation in the stiffness due to different temperatures is negligible based on the redistribution of the volume, allowing a similar rate of compression at any temperature. This improves the bite control and sound performance at any temperature that is required for operation.

The bumper component 20 also includes a main body portion 24 that is separated from the head portion 22 with a necked portion 26 of the bumper component 20.

Referring again to FIG. 1, four heat posts 30 are added to the housing 12 to reduce the number of screws. This advantageously reduces the part count of the assembly and assembly complexity.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A vehicle latch assembly, comprising:

a housing;

a pawl disposed within the housing, the pawl rotatable between a first angular position and a second angular position; and a bumper operatively coupled to the housing, the bumper having a cone shaped head portion positioned for engagement with the pawl in the second angular position of the pawl, the cone shaped head portion being connected to a main body portion of the bumper by a neck portion, and the cone shaped head portion having a circular outer periphery that is greater than the neck portion, the cone shaped head portion being solid and tapers from the circular outer periphery to an apex of the cone shaped head portion, the apex engages the pawl when the pawl is in the second angular position, the bumper further comprising a second cone shaped portion.

2. The vehicle latch assembly of claim 1, wherein the bumper is at least partially formed of rubber.

3. The vehicle latch assembly of claim 1, wherein the bumper is at least partially formed of a polymer.

4. The vehicle latch assembly of claim 1, wherein the bumper is press fitted to the housing.

5. The vehicle latch assembly of claim 1, wherein the main body portion includes at least one curved edge.

6. A vehicle latch assembly, comprising:

a housing;

a pawl disposed within the housing, the pawl rotatable between a first angular position and a second angular position;

a bumper operatively coupled to the housing, the bumper having a cone shaped head portion positioned for engagement with the pawl in the second angular position of the pawl, the cone shaped head portion being connected to a main body portion of the bumper by a neck portion, and the cone shaped head portion having a circular outer periphery that is greater than the neck portion, the cone shaped head portion being solid and tapers from the circular outer periphery to an apex of the cone shaped head portion, the apex engages the pawl when the pawl is in the second angular position, the bumper further comprising a second cone shaped portion; and a plurality of heat stake posts formed on the housing to operatively couple components of the vehicle latch assembly.

7. The vehicle latch assembly of claim 6, wherein the bumper is at least partially formed of rubber.

8. The vehicle latch assembly of claim 6, wherein the bumper is at least partially formed of a polymer.

9. The vehicle latch assembly of claim 6, wherein the bumper is press fitted to the housing.

10. The vehicle latch assembly of claim 6, wherein the main body portion includes at least one curved edge.

* * * * *